US005355658A

United States Patent [19]

Thiede

[11] Patent Number: 5,355,658

[45] Date of Patent: Oct. 18, 1994

[54] PACKAGING MACHINE WITH ADJUSTABLE SIDES FOR A BUCKET

[75] Inventor: Danny S. Thiede, Lakeville, Minn.

[73] Assignee: Thiele Engineering Company, Minneapolis, Minn.

[21] Appl. No.: 972,926

[22] Filed: Nov. 6, 1992

[51] Int. Cl.[5] ..... B65B 39/14; B65B 59/02; B65B 65/02

[52] U.S. Cl. ..... 53/566; 53/252; 493/479

[58] Field of Search ..... 493/479, 478, 475; 53/252, 251, 566, 564

[56] References Cited

U.S. PATENT DOCUMENTS

| | | | |
|---|---|---|---|
| 2,662,355 | 12/1953 | Ross | 53/566 |
| 2,999,344 | 9/1961 | Clanin et al. | 53/566 |
| 3,333,514 | 8/1967 | Jones | 53/566 X |

*Primary Examiner*—James F. Coan
*Attorney, Agent, or Firm*—Hugh D. Jaeger

[57] ABSTRACT

Adjustable bucket packaging machine for the packaging of items and literature into a carton having conveyored buckets whose size is readily adjustable by phase adjusters, which move the leading and trailing bucket members about a central member. Alignment of adjacent loading devices is also accomplished by the use of phase adjusters, as well as spacing of flites along a conveyor system which is also adjusted by phase adjusters.

3 Claims, 10 Drawing Sheets

PACKAGING MACHINE WITH ADJUSTABLE SIDES FOR A BUCKET

BACKGROUND OF THE INVENTION

1. Field of the Invention

The present invention pertains to a packaging machine, and more particularly, pertains to a packaging machine having readily adjustable buckets, which are adjustable by the use of phase adjusters.

2. Description of the Prior Art

The prior art packaging machines have provided buckets which were built for one size application or which were adjustable only by common hand tools over a relatively lengthy time span where numerous adjustments were required at numerous points along the packaging machine. Often these adjustments were costly in effect due to time and man power expended.

The present invention provides a packaging machine having phase adjusters to adjust the bucket sides.

SUMMARY OF THE INVENTION

The general purpose of the present invention provides an adjustable bucket packaging machine having phase adjustor control for a number of members requiring alignment. The entire invention is housed in a quantity of connected framework sections.

According to one embodiment of the present invention, there is provided a packaging machine including a bottle/literature conveyor and carton conveyor which align generally along either side of a center line of the machine, and include an area of side-by-side overlap for the purpose of transfer of product items from the bottle/literature conveyor to the carton conveyor. Bottled product and literature are supplied by conveyors or placers to points adjacent to or over the bottle/literature conveyor. The bottled product is placed on the bottle literature conveyor. A literature loader then places literature in close proximity to the bottled product on the bottle/literature conveyor. The bottle and literature are then conveyed to a carton loader and loaded therein. A set of phase adjusters at one end of the bottle/literature conveyor adjusts the size of the buckets on the bottle/literature conveyor. The literature loader has a phase adjustor to align it with elements of the bottle/literature conveyor. A carton loader at the midsection of the packaging machine loads the bottle and literature from the bottle/literature conveyor into a carton. The carton loader includes a phase adjustor controlled shaft which is common to the bottle/literature conveyor, the carton loader and a plurality of loading devices. The carton conveyor has leading and trailing flites, the spacing of which is controlled by phase adjustor. An adjustable accessory rail aligns along the length of the invention for single point adjustment of ancillary structure toward or from the center.

One significant aspect and feature of the present invention is the use of phase adjusters to adjust bucket size on a conveyor.

Another significant aspect and feature of the present invention is the use of phase adjusters to align a literature loader with adjustable buckets on a conveyor.

A further significant aspect and feature of the present invention is the use of phase adjusters to adjust flite spacing on a conveyor.

An additional significant aspect and feature of the present invention is the use of phase adjusters to adjust adjustable buckets, loading funnels and a carton loader with respect to a conveyor having phase adjusted flites.

Having thus described embodiments of the present invention, it is a principal object of the present invention to provide an adjustable bucket packaging machine where bucket size and other adjustments are readily provided by the use of phase adjusters.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, which like reference numerals designate like parts throughout the figures thereof and wherein.

DETAILED DESCRIPTION OF THE PREFERRED EMBODIMENTS

Figure 1:
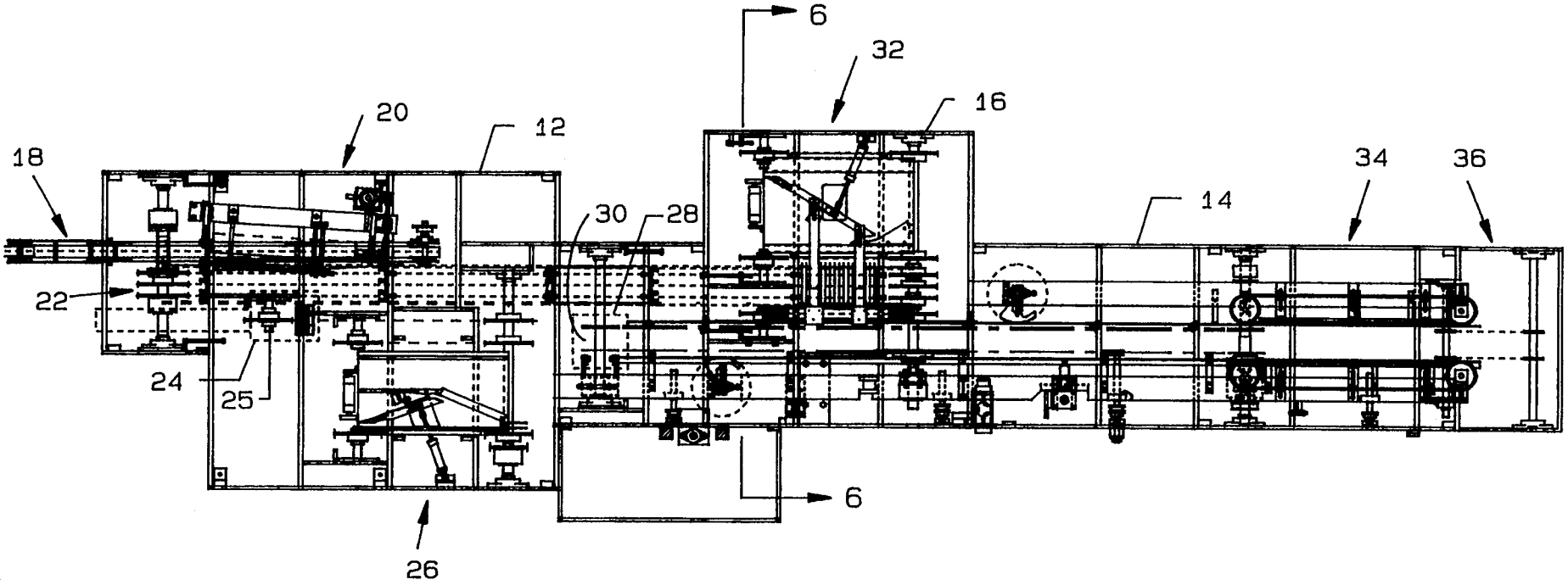
FIG. 1 illustrates a plan view of the adjustable bucket packaging system, the present invention.

FIG. 1 illustrates a plan view of a packaging machine 10 with adjustable buckets, the present invention, including adjacent frameworks 12 and 14, and framework 16 extending from framework 14. Major areas or components of the adjustable bucket packaging machine 10 are now described below and are not limited to the following members or devices. A bottle conveyor 18, a bottle loader 20, a bottle/literature conveyor 22, a literature placer and supply track 24, a literature conveyor 25 and a literature loader 26, the majority of these components mount entirely to the first framework 12. Frameworks 16 and 14 include an overhead carton placer and supply 28, a carton conveyor 30, a carton loader 32, a compression discharge 34, and an off load conveyor 36. The bottle/literature conveyor 22 extends along framework 12, across the left end of the framework 14, and into framework 16 where it terminates on a shaft common to the carton loader 32 and a funnel carriage mechanism 188 as later described in detail. A number of phase adjusters locate about the adjustable bucket packaging machine 10 to adjust flites, literature loaders, carton loaders and other alignable devices with respect to each other as later described in detail.

Figure 2:
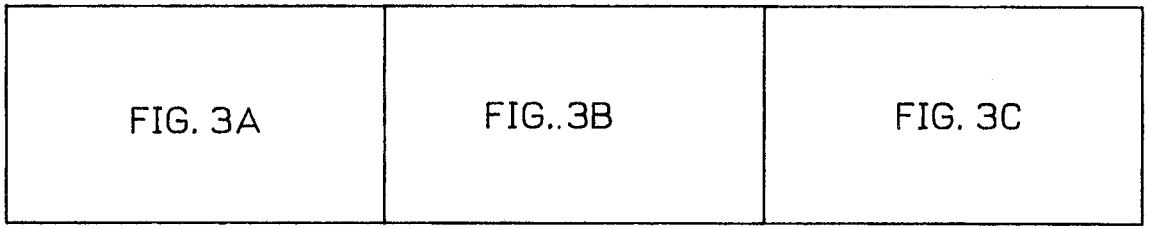
FIG. 2 illustrates the alignment of FIGS. 3A, 3B and 3C with respect to each other.
Figure 3A:
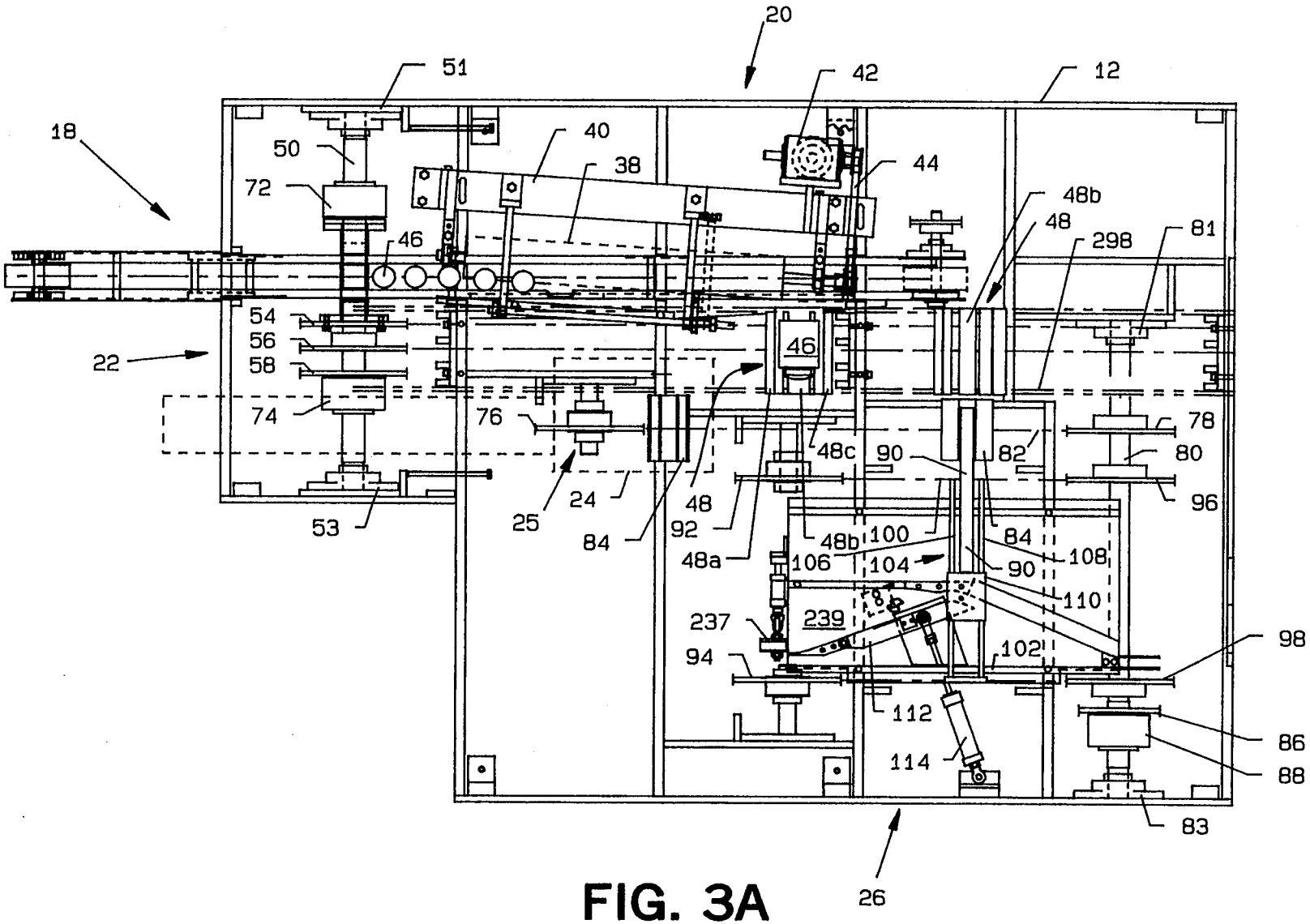
FIGS. 3A, 3B and 3C, in alignment, illustrate a detailed plan view of the adjustable bucket packaging system.
Figure 3B:
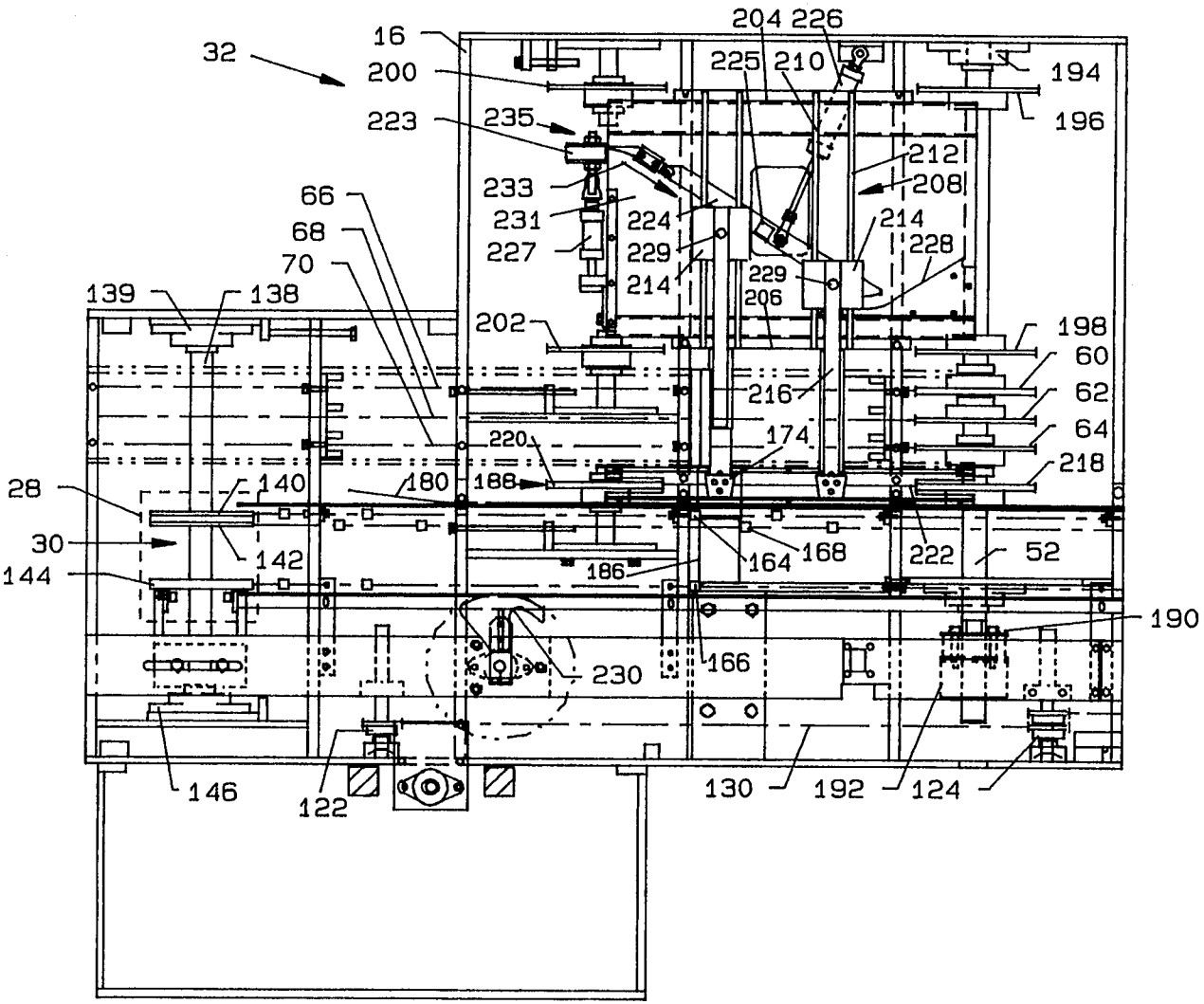
Figure 3C:
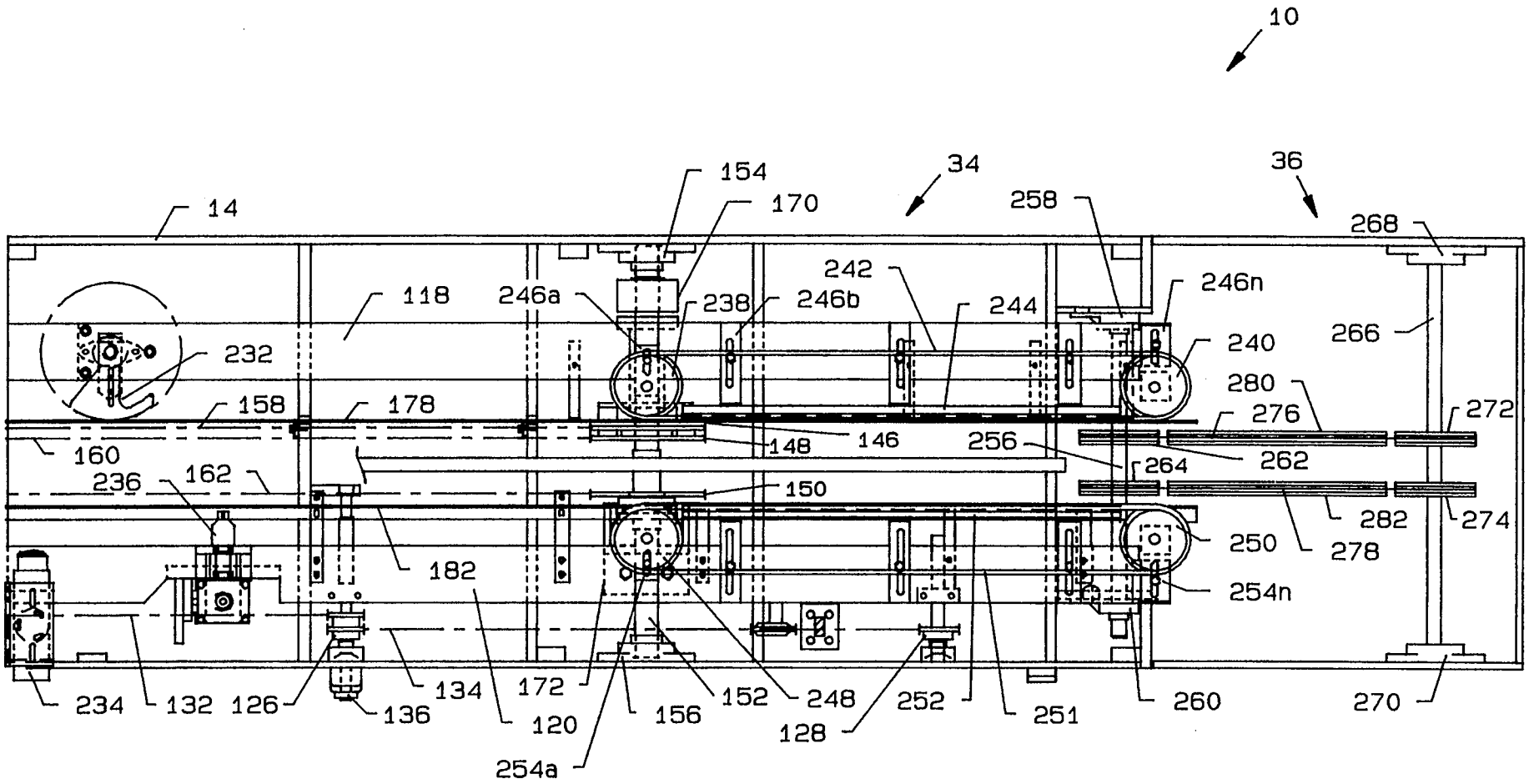

FIG. 2 illustrates the alignment of FIGS. 3A, 3B and 3C with respect to each other.

FIG. 3A, 3B and 3C in alignment illustrate a detailed plan view of the adjustable bucket packaging machine 10 where all numerals correspond to those elements previously described. The bottle conveyor 18 secures to the framework 12 and extends to align with an infeed screw 38 which in turn secures to the framework 12 via an adjustable bracketed fixture 40. A motor 42 and a belt 44 drive the infeed screw 38. Product bottles 46 are driven by the angularly aligned infeed screw 38 and subsequently tipped onto one of a plurality of buckets 48 aligned along and about the bottle/literature conveyor 22. The bottle/literature conveyor 22 extends between a shaft network 50 in framework 12 to a splined head shaft 52 mounted in framework 16. The shaft network 50 mounts between bearings 51 and 53 on the framework 12. Sprockets 54, 56 and 58 align over and about the shaft network 50 at one end of the bottle/-literature conveyor 22, and sprockets 60, 62 and 64 align over the splined head shaft 52 at the opposing end. Chains 66, 68 and 70 align between the sprocket sets 54-60, 56-62 and 58-64. A plurality of buckets 48, not all of which are illustrated and whose size is adjustable, adjustably aligns over the chains 66, 68 and 70. Adjustability of the size of the bucket 48 is effected by phase adjusters 72 and 74 which align over and about the shaft network 50. The phase adjustor 72 adjusts the sprocket 54, chain 66, and thus the trailing bucket member 48*a* with respect to the relatively fixed position sprocket 56, chain 68, sprocket 62 and bucket base 48*b*. In a like fashion, the phase adjustor 74 adjusts the sprocket 58, chain 70, and thus adjust the leading bucket member 48*c* with respect to relatively fixed position sprocket 56, chain 68 and bucket base 48*b*. Ultimately all three chains 66, 68 and 70 are rotated simultaneously after an angular adjustment has been effected to fit and align bucket trailing and leading member 48*a* and 48*c* about the bucket base 48*b*.

The literature placer and supply 24 aligns over the literature conveyor 25 to supply literature feed for the literature loader 26. The literature conveyor 25 includes a frame mounted sprocket 76, a drive sprocket 78 affixed to a frame mounted shaft 80, a chain 82, guide bars (not illustrated) and a plurality of literature trays, including literature tray 84, mounted to the chain 82. Only one literature tray 84 is illustrated for purposes of brevity and clarity. The shaft 80 mounts between bearings 81 and 83 on framework 12 and includes a drive sprocket 86 and a controlling phase adjustor 88 which adjusts the literature tray 84 relative to the center bucket base 48*b* of the bucket 48. Also connected to the shaft 80 is the literature loader 26 having a plurality of push arms of which only one is illustrated including a push arm 90, which pushes or tamps one end or more of literature in the literature tray 84 into the hollow bucket base 48*b* of bucket 48 and across the cap of the product bottle 46 so that the bottle 46 and literature are ready to be inserted into a carton. The literature loader 26 includes frame mounted sprocket 92 and 94, sprockets 96 and 98 secured over and about the shaft 80, and chains 100 and 102 aligned, respectively, over and about the sprockets 94–98. A plurality of push arm assemblies 104 containing the push arm 90 mounts across the chains 100 and 102 in alignment with the plurality of literature trays 84. The push arm assemblies 104 include slide rods 106 and 108 mounted between chains 100 and 102. A base member 110 having guide holes slidingly engages the slide rods 106 and 108. A guide member 112 is positionable by a hydraulic cylinder 114. The guide member 112 causes the base member 110 and the attached push arm 90 to move inwardly, thus moving the literature in the literature tray 84 into the hollow bucket base 48*b* as previously described. A fixed guide member 116 causes the push arm 90 to retract from the literature tray 84.

Accessory rails 118 and 120 align in parallel along the framework 14. Accessory rail 18 is fixed while accessory rail 120 is adjustable across the framework 12 by means of screw adjusters 122, 124, 126, and 128 and chains 130, 132 and 134 connecting the screw adjusters as illustrated. A positioning gauge 136 connects to screw adjustor for determining the position of the adjustable framework with reference to carton sizes.

The overhead carton placer and supply 28 aligns over a tail shaft 138 having sprockets 140, 142 and 144 aligned over and about its circumference which forms one end of the carton conveyor 30. One end of the tail shaft 138 mounts to a conventional frame mounted bearing 139, while the opposing end mounts in a take-up bearing 146. Opposing sprockets 146, 148 and 150 align over and about a shaft network 152 between bearings 154 and 156 on framework 14. Chains 158, 160, and 162 align over and about sprocket sets 140-146, 142-148, and 144-150. Chains 158 and 162 include a plurality of trailing flites including flites 164 and 166, respectively, and the middle chain 160 includes a leading flite 168. The shaft network 152 also includes phase adjusters 172 and 170 which control the adjustment of the leading and trailing flites 168, and 164–166 with respect to carton size and with respect to position relative to carton loading funnels 174 as later described in detail. A fixed carton rail 178, having a plow 180, is supported by the fixed accessory rail 118 on one side of the carton conveyor 30. Another rail 182 is supported by the adjustable accessory rail 120 on the opposing side of the carton conveyor 30. A carton hold down rail 184 aligns across the top of the carton conveyor 30 and extends also over the area between the components of the compression discharge 34.

The carton loader 32 generally aligns in the framework 16. The carton loader loads the product bottle 46 and literature aligned to the top of the product bottle 46 into cartons such as carton 186 aligned between flites 164–166 and 168 of the carton conveyor 30. One end of the carton loader 32 is supported by the splined head shaft 52 which is in common with the bottle/literature conveyor 22 and a funnel carriage mechanism 188. The splined head shaft 52 is driven by a sprocket 190 through a phase adjustor 192 which secures to the adjustable accessory rail 120. Sprockets 196 and 198 align over and about the splined head shaft 52 in alignment with opposing frame mounted sprockets 200 and 202. Chains 204 and 206 align over and about the sprocket sets 196-200 and 198-202, respectively. A plurality of push arm assemblies, including push arm assembly 208, similar to push arm assemblies 104, having slide rods 210 and 212, a base member 214 and a push arm 216 aligned across the chains 204 and 206. The push arms 216 align with funnels 174 and 176 which are supported by the funnel carriage mechanism 188. The funnel mechanism 188 includes a sprocket 218 aligned over and about the splined shaft 52, a sprocket 220 mounted to the framework 16, a chain 222 and funnels such as funnels 174 and 176 which can be of different proportion depending upon the size of a product bottle and carton. An input channel 223 operated by a pneumatic cylinder 227 can be positioned as illustrated to channel the guide pin 229 of the push arm base member 214 onto a planar surface 231 of the carton loader 32 and against the guide member 224 as indicated by arrow 233. In the event that a shortage of either product bottles, literature or cartons is detected, the input channel 223 is pneumatically activated to the position shown by arrow 235 to remove the base members 214 from contact with the guide member 224, thus reducing the strike of the push arms 216 to zero so that the loading process ceases. Another input channel 237 similar in design and operation to the input channel 223 and its adjacent components is fixed to the leading edge of the literature loader 26 to select a non-loading path or a loading path along the planar surface 239 of the literature loader 26. The guide member 224 is held in place by a pneumatic cylinder 226 under low pressure and causes the base member 214 to move inwardly, thus moving the push arm 216 inwardly to push the product bottle and literature into the awaiting erected carton 186. Jamming of any of the push arm assemblies, such as jammed bottles, mechanical misalignment or other causes, is sensed to shut the machine off. A proximity switch 225 is located on the guide member 224. A jam will cause movement of the guide member toward a low pitch position against the lightly pressurized pneumatic cylinder 226, causing activation of the proximity switch 225, thus causing stoppage of the machine. Another guide member 228 causes the push arm 216 to retract from the funnel area.

Rotary flap tuckers 230 and 232 located on the adjustable accessory rail 120 and the fixed accessory rail 118, respectively, position carton flaps as necessary during the packaging process. Also located on the adjustable accessory rail are a luminescent literature scanner 234 and a code head 236.

Loaded cartons, such as carton 186, are conveyed along the carton conveyor 30 until intercepted by the compression discharge 34. The compression discharge 34 includes pulleys 238 and 240, one of which is driving a belt 242, a belt backings trip 244 which are mounted by adjustable brackets **246*a*–246*n* to the fixed accessory rail 118. In a similar fashion, pulleys 248 and 250, one of which is driven, a belt 251, a belt backing strip 252, which are mounted by adjustable brackets 254*a*–254*n* to the adjustable accessory rail 120. The off load conveyor 36 includes a driven shaft 256 between bearings 258 and 260 on framework 14, pulleys 262 and 264, a tail shaft 266 between bearings 268 and 270 on framework 14, pulleys 272 and 274 over and about the tail shaft 266, belts 276 and 278 between pulley pairs 262-272 and 264-274, respectively, and belt supports 280 and 282 below the belts 276 and 278**.

Figure 4:
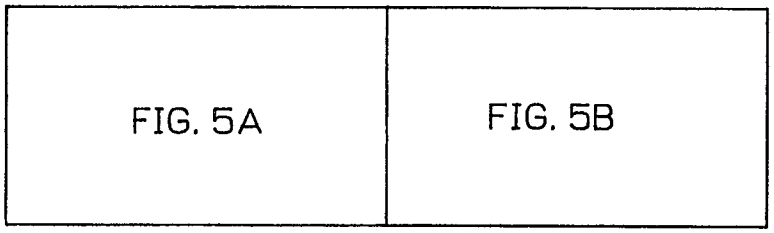
FIG. 4 illustrates the alignment of FIGS. 5A and 5B with respect to each other.
Figure 5A:
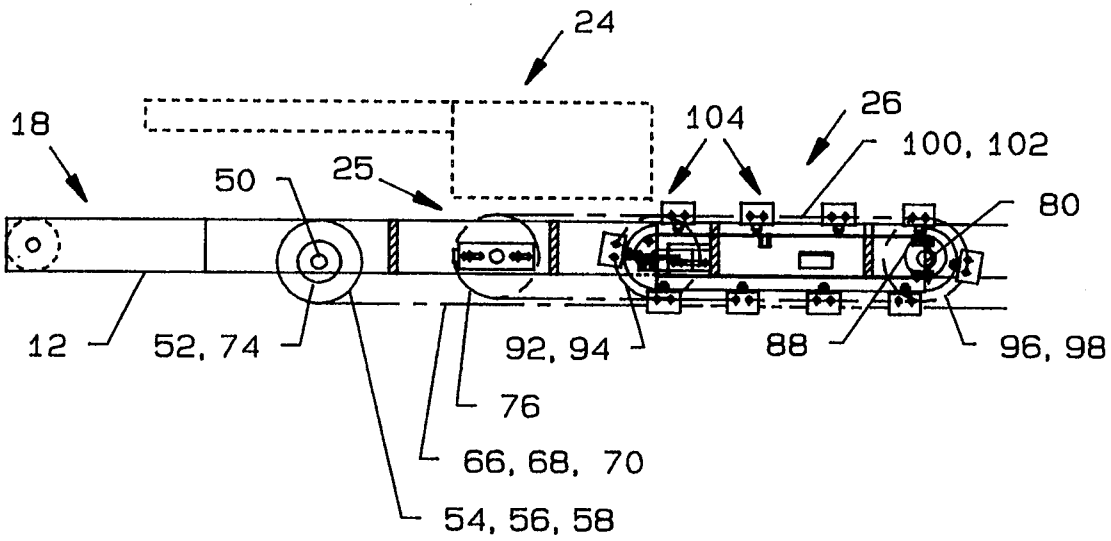
FIGS. 5A and 5B, in alignment, illustrate a conceptual side view of the adjustable bucket packaging system.
Figure 5B:
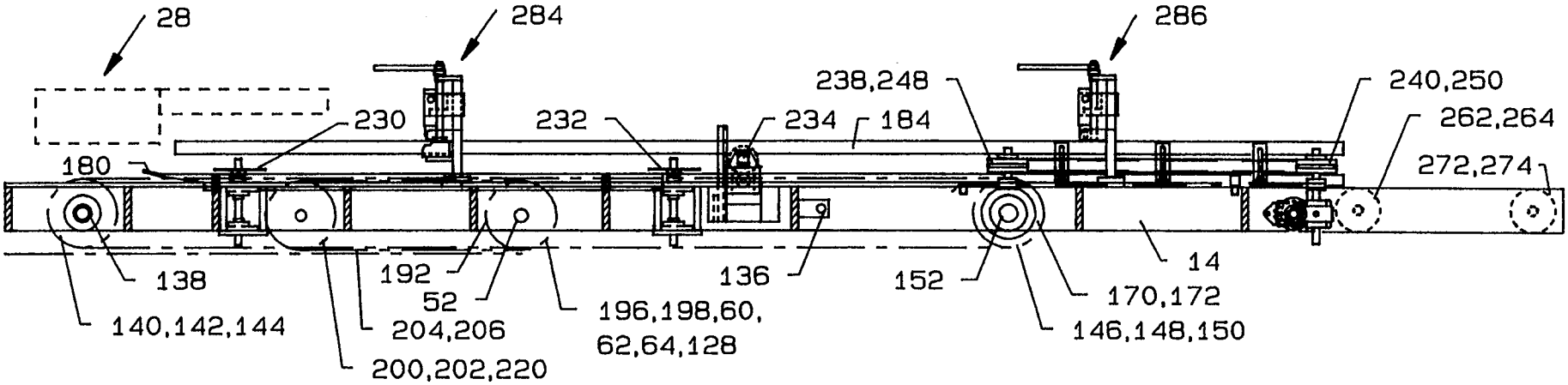

FIG. 4 illustrates the alignment of FIGS. 5A and 5B with respect to each other.

FIGS. 5A and 5B, in alignment, illustrate a conceptual side view showing the placement of the majority of the components of the adjustable bucket packaging machine 10 where all numerals correspond to those elements previously described. Also described is the hold down rail 184 secured to the framework 14 by adjustor clamps 284 and 286.

Figure 6:
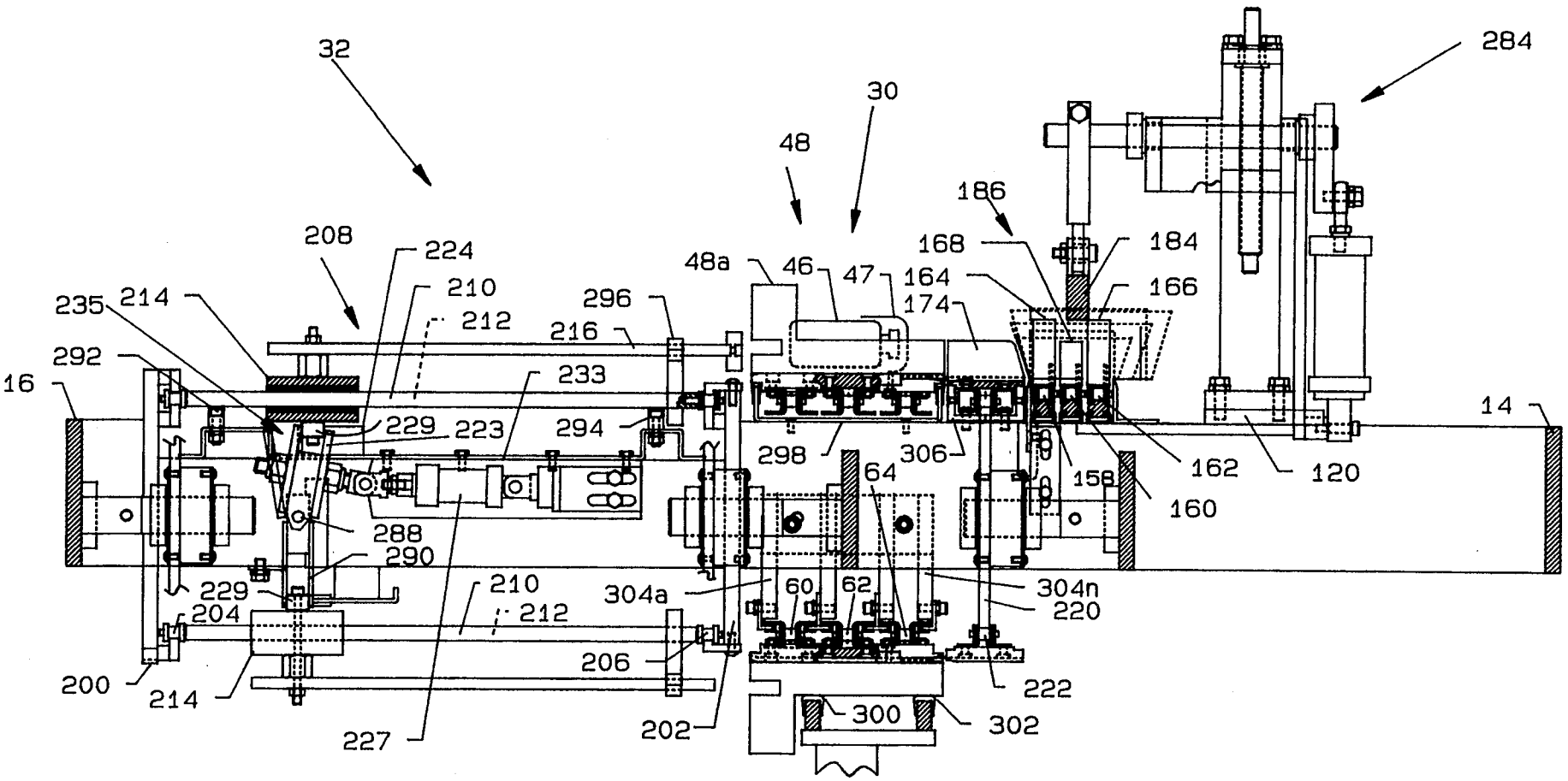
FIG. 6 illustrates a cross-sectional view of the carton loader along line 6—6 of FIG. 1; and, FIG. 7 illustrates the alignment of a product bottle and literature in a bucket with a funnel and carton.

FIG. 6 illustrates a cross-sectional view of the carton loader 32 along line 6—6 of FIG. 1 where all numerals correspond to those elements previously described. Illustrated in particular is the push rod assembly 208 and the alignment of the product bottle 46 and literature 47 in the adjustable bucket 48 with the loading funnel 174 and carton 186 within the flites 164–166, and 168.

Pneumatic cylinder 227 positions the input channel 223 about a pivot point 288 to send the guide pin 229 along the guide member 224 as illustrated, or in the event of unavailability of product bottles, literature or cartons, the guide member is pneumatically positioned to a position shown by arrow 235 to send the base member 214 along a straight line path as previously described to stop push arm movement. A return channel 290 aligns returning base members 214 to the input channel 223. Also illustrated are support members 292 and 294 which support the slide rods 210 and 212 and a push arm support 296 supported by slide rods 210 and 212.

Bucket 48, comprised of members **48*a*, 48*b* and 48*c*, is supported by a channel 298 along the upper length of the carton conveyor 30 and by support members 300 and 302 along the lower length of the carton conveyor 30. Lower chain guide assemblies 304*a*–304*n* support the chains 60, 62 and 64 along the chain return path. A channel 306 supports the loading funnel 174 along the length of the carton loader 32**.

Figure 7:
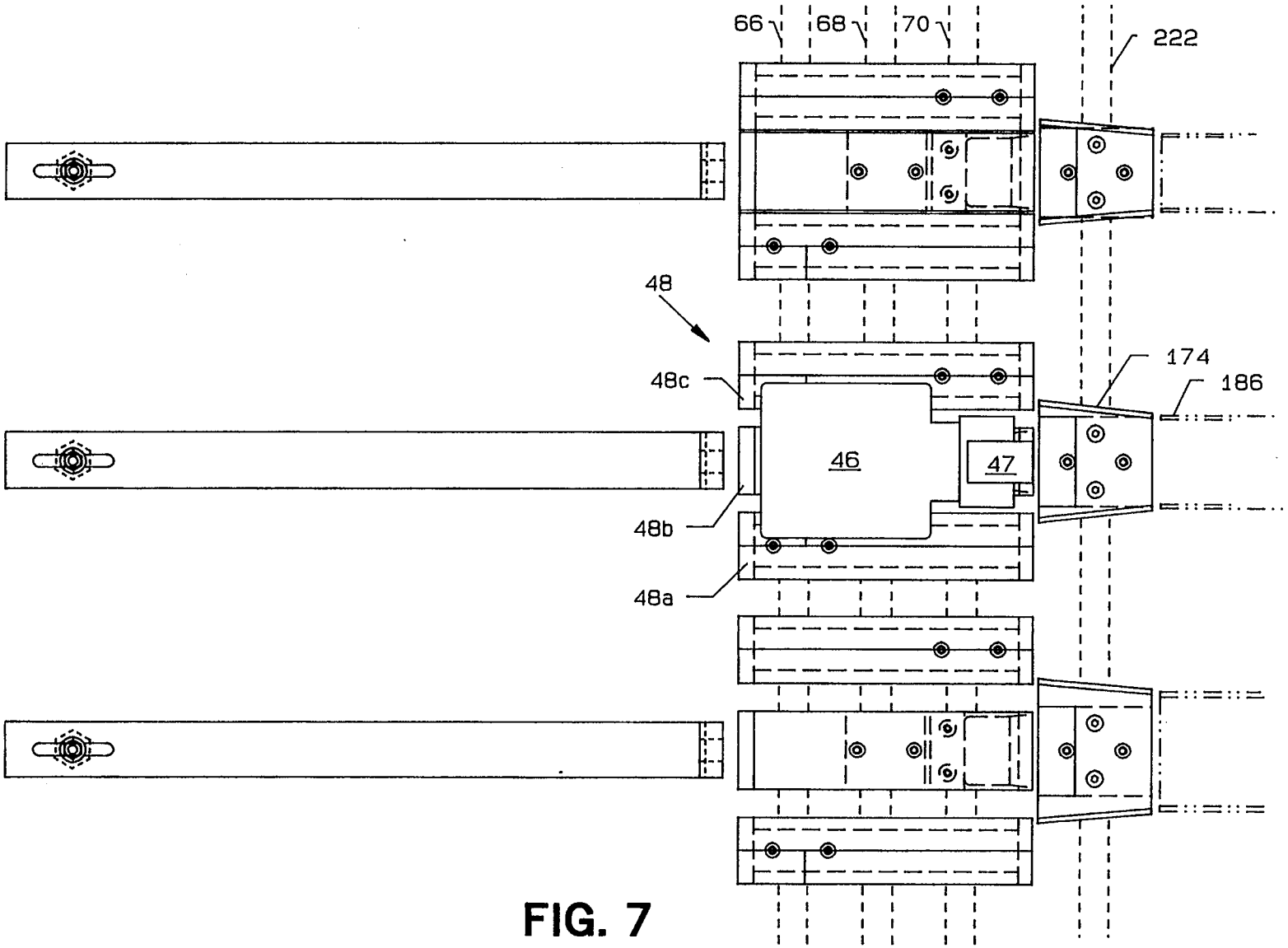

FIG. 7 illustrates the alignment of a product bottle 46 and literature 47 in a bucket 48 with a loading funnel 174 and carton 186. The buckets 48 are illustrated at different spacings for purposes of illustration only. It is noted that the bucket base **48*b* remains as the fixed center member, while the leading member 48*c* and the trailing member 48*a* are adjusted with reference to the bucket base member 48*b*. For actual operation, the spacings would be consistent within bucket members 48. It is also noted that the loading funnels 174 can also be of different sizes to match the size of a carton 186**.

MODE OF OPERATION

FIGS. 3A–3C and reference to other figures best illustrate the modes of operation of the adjustable bucket packaging machine 10, the present invention. Product bottles 46 are fed by the bottle conveyor 18 into the bottle loader 20 in a vertical position and then stopped to a horizontal position upon leaving the infeed screw 38 to be deposited in an adjustable bucket 48 on the bottle/literature conveyor 22. The adjustable bucket 48 is varied to approximate the size of the product bottle 46 by phase adjusters 72 and 74. Positioning of the trailing bucket member **48*a* and the leading bucket member 48*c* are made relative to the bucket base member 48*b* as follows. Phase adjustor 72 simultaneously adjusts the position of the sprocket 54, the chain 66 and most importantly, the trailing bucket member 48*a* with respect to the associated bucket base member 48*b*, including the sprocket 56, chain 68, sprocket 62 and the bucket base member 48*b*. The opposing phase adjustor 74 in a similar fashion simultaneously adjusts the sprocket 58, chain 70 and most importantly, the leading edge bucket 48*c* with respect to the bucket base 48*b* and associated members. The bottled product 46, now aligned in the adjusted bucket 84, proceeds along the bottle/literature conveyor 22 and adjacent to aligned literature buckets 84 which are conveyored to the literature loader 26. The literature conveyor 25 parallels the bottle/literature conveyor 22 and contains literature in from the literature placer and supply track 24 literature trays 84. The literature tray 84 and the push arm 90 of the literature loader are aligned to the product bottle 46 in the bucket 48 so that the push arm 90 can feed one end of the literature into the hollow bucket base 48*b* and across the cap of the product bottle 46. The alignment of the push arm 90 and the literature bucket is effected by adjusting the phase adjustor 88 on shaft 80 to simultaneously advance or retard the position of the push arm 90 and literature bucket 84 with respect to the adjustable bucket 48**. This adjustment is made subsequent to other adjustments as described later in detail.

After loading of literature, the adjustable bucket 48 with on board literature and bottled product proceeds on the bottle/literature conveyor 22 to the carton loader 32 where push arms 216 push the bottled product and semi-surrounding literature from the adjustable bucket 48 through the funnels such as loading funnel 174 and into an aligned carton 186 traveling between the flites 164–166 and 168 on the parallel carton conveyor 30. At this point, it is noted that splined head shaft 52 and its associated components including a phase adjustor 192 comes into play with simultaneous alignment of the buckets 48, loading funnels 174 and push arms 216 to the center of the flites 164–166 and 168 by adjustment of the phase adjustor 192. The entire splined head shaft 52 associated sprockets, chains and buckets are simultaneously adjusted while maintaining their previously set spacings and relative positions by actuation of the phase adjustor 192.

Cartons 186 are erected and placed by the carton placer and supply 28 and placed between flites 164–166 and 168 on the carton conveyor 30 and are conveyed in a parallel fashion to align with the loading funnels 174 of the carton loader 32. The spacing between the trailing flite members 164–166 and the loading flite members 168 is effected by phase adjusters 170 and 172 along the shaft network 152. Adjustment of the phase adjustor 172 controls the position of the sprocket 148 and 142, chain 160 and leading flite 168 with respect to the lateral flat center and adjustment of the phase adjustor 170 controls the position of the sprockets 146 and 150, the chains 158 and 162, sprockets 140 and 144, and trailing flites 164–166 with respect to the lateral flite center.

Plow 180, rotary flap tuckers 230 and 232 and the glue machines glue and close flaps along the carton conveyor 30. The filled and sealed carton 186 then transfers from the carton conveyor 30 to the compression discharge and off load conveyor. The typical setup sequence with regard to phase adjusters would call first for the adjustment of the carton tailing flites 164–166 and leading flites 168 to the proper size of phase adjusters 170 and 172 about the lateral center line of the carton flites 164–166 and 168. The next to be adjusted are the adjustable buckets 48 including the leading bucket member **48*c* and the trailing bucket members 48*a* which are adjusted about the center bucket member 48*b* by the phase adjusters 72 and 74, respectively. Subsequent to this adjustment, phase adjustor 192 on splined head shaft 52 is adjusted to simultaneously bring the bucket 48, the loading funnels 174 and the push arms 216 into alignment with the lateral center of the flites 164–166 and 168 on the carton conveyor 30. One of the final adjustments is that of aligning the push arms 90 and literature tray 84 of the literature loader 26 with the bucket base 48*b* of the bucket 48 by use of the phase adjustor 88**.

There are five phase adjusters. One phase adjuster is on the tail shaft of the in feed and adjusts the leading bucket side and the other phase adjuster adjusts the trailing bucket side. A phase adjuster is on the literature loader head shaft, which phases the literature loader and the literature bucket to the pocket of the center in feed bucket. The phase adjuster on the head shaft of the carton flites phases the leading flite for a variation in carton sizes. The phase adjuster on the head shaft of the loader phases the product loader and the funnel buckets to the erected carton or the carton flite.

Various modifications can be made to the present invention without departing from the apparent scope hereof.

We claim:

1. A packaging machine comprising:

a. a frame means;

b. a carton loader shaft;

c. a first chain means connected to said carton loader shaft;

d. at least one bucket having a base connected to said chain means and at least one bucket side;

e. a second chain means connected to said carton loader shaft, the second chain means connected for angular adjustment about the head shaft, the bucket side being mounted on the second chain means;

f. at least one phase adjuster means mounted over the shaft, spaced apart from the second chain means, for angularly adjusting the second chain means relative to the first chain means for adjusting the bucket side relative to the base.

2. A packaging machine comprising:

a. a frame;

b. a shaft rotatably mounted on the frame for driving components of the packaging machine;

c. a first sprocket mounted on the shaft;

d. a first chain mounted on the first sprocket for movement as the shaft rotates;

e. a bucket base mounted on the first chain;

f. a second sprocket mounted on the shaft and angularly adjustable on the shaft relative to the first sprocket;

g. a second chain mounted on the second sprocket for movement as the share rotates;

h. a bucket side mounted on the second chain; and, i. a phase adjuster connected to the second sprocket, spaced apart from the second sprocket along the shaft, for altering angular position of the second sprocket relative to the first sprocket, and therefore position of the side relative to the base, without manual contact with either sprocket.

3. The packaging machine of claim 2 further comprising:

j. a third sprocket mounted on the shaft and angularly adjustable on the shaft relative to the first chain;

k. a third chain mounted on the third sprocket for movement as the shaft rotates;

l. a second bucket side mounted on the third chain; and, m. a second phase adjuster connected to the third sprocket, spaced apart from the third sprocket along the shaft, for altering angular position of the third sprocket relative to the first sprocket, and therefore position of the second bucket side relative to the base, without manual contact with any sprocket.

* * * * *